US005569931A

United States Patent [19]

Ghini et al.

[11] Patent Number: 5,569,931

[45] Date of Patent: Oct. 29, 1996

[54] METHOD AND APPARATUS FOR DETECTING FILING STATE AT AN OPEN END OF A CIGARETTE

[75] Inventors: Marco Ghini, Lazzaro di Savena; Giuseppe Di Stefano, Ferrara; Armando Neri, Bologna, all of Italy

[73] Assignee: G.D Societa' per Azioni, Bologna, Italy

[21] Appl. No.: 273,227

[22] Filed: Jul. 11, 1994

[30] Foreign Application Priority Data

Jul. 13, 1993 [IT] Italy ..... BO93A0320

[51] Int. Cl.[6] ..... G01N 21/86

[52] U.S. Cl. ..... 250/559.45; 250/559.4; 358/237

[58] Field of Search ..... 250/222.1, 223 R, 250/221, 559.46, 559.45, 559.4; 382/143, 110, 218; 209/536; 137/108, 280, 281; 73/865.8; 356/237, 445, 448

[56] References Cited

U.S. PATENT DOCUMENTS 4,644,176 2/1987 Heitmann et al. ..... 250/559.46
5,223,915 6/1993 Neri ..... 356/398

*Primary Examiner*—Que T. Le
*Attorney, Agent, or Firm*—Ladas & Parry

[57] ABSTRACT

The filling of a cigarette under observation is controlled by intersecting the open-end surface of the cigarette with at least one coherent light blade emitted by at least one laser source, to form a respective real light trace, and by analyzing any deviation or discontinuity of the real trace in relation to a theoretical, straight, continuous trace formed by joining two end points of the real trace, to obtain a signal indicating acceptance or rejection of the cigarette under observation.

16 Claims, 3 Drawing Sheets

METHOD AND APPARATUS FOR DETECTING FILING STATE AT AN OPEN END OF A CIGARETTE

BACKGROUND OF THE INVENTION

The present invention relates to a cigarette filling optical control method.

More specifically, the present invention relates to a control method for determining the presence or absence of tobacco at the open end of cigarettes on a cigarette manufacturing machine and/or filter assembly machine and/or packing machine.

At the output of a cigarette manufacturing machine and/or filter assembly machine and/or at the input of a packing machine, the cigarettes are normally subjected to numerous checks comprising a check of the filling to determine the presence or absence of tobacco at the open end of the cigarettes.

In most cases, filling control consists in illuminating the front surface of the open end of the cigarette by means of a light source; forming an image of the front surface by means of a detecting unit featuring a telecamera or equivalent optical monitoring system; and transmitting the image to a comparing unit for comparing it with a specimen image and emitting a reject signal in the event the detected and specimen images differ over and above a given limit.

In general, the difference in the detected and specimen images depends on differences in shading which, as is known, varies according to the presence of gaps on the front surface due to the absence of tobacco. Unfortunately, the shading of the detected image has been found to depend largely, not only on the presence of gaps, but also on the colour of the tobacco employed, so that known devices of the above type involve expensive, time-consuming setup procedures whenever the type of tobacco is changed.

SUMMARY OF THE INVENTION

It is an object of the present invention to provide a straightforward, low-cost optical control method designed to overcome the aforementioned drawbacks.

According to the present invention, there is provided a cigarette filling optical control method, characterized in that it comprises the steps of intersecting the open-end surface of the cigarette under observation with at least one coherent light blade emitted by at least one laser source to form, on said surface, a respective real light trace; and in analyzing any deviation or discontinuity of the real trace in relation to a respective theoretical, straight, continuous trace formed by joining two end points of the real trace, to obtain a signal indicating acceptance or rejection of the cigarette under observation.

The present invention also relates to a cigarette filling optical control device.

According to the present invention, there is provided a cigarette filling optical control device, characterized in that it comprises laser emitting means for emitting at least one coherent light beam; a focusing unit for converting said beam into a coherent light blade so directed as to intersect the open-end surface of the cigarette under observation; sensor means for detecting a real trace of said light blade on said surface; and processing means for analyzing any deviation or discontinuity of said real trace in relation to a respective theoretical, straight, continuous trace formed by joining two end points of said real trace, and for producing a signal indicating acceptance or rejection of the cigarette under observation.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 2:
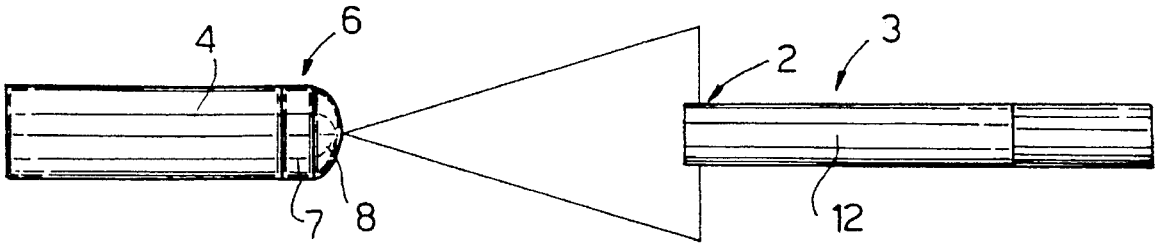
FIG. 2 shows a schematic plan view of a first detail in FIG. 1.
Figure 1:
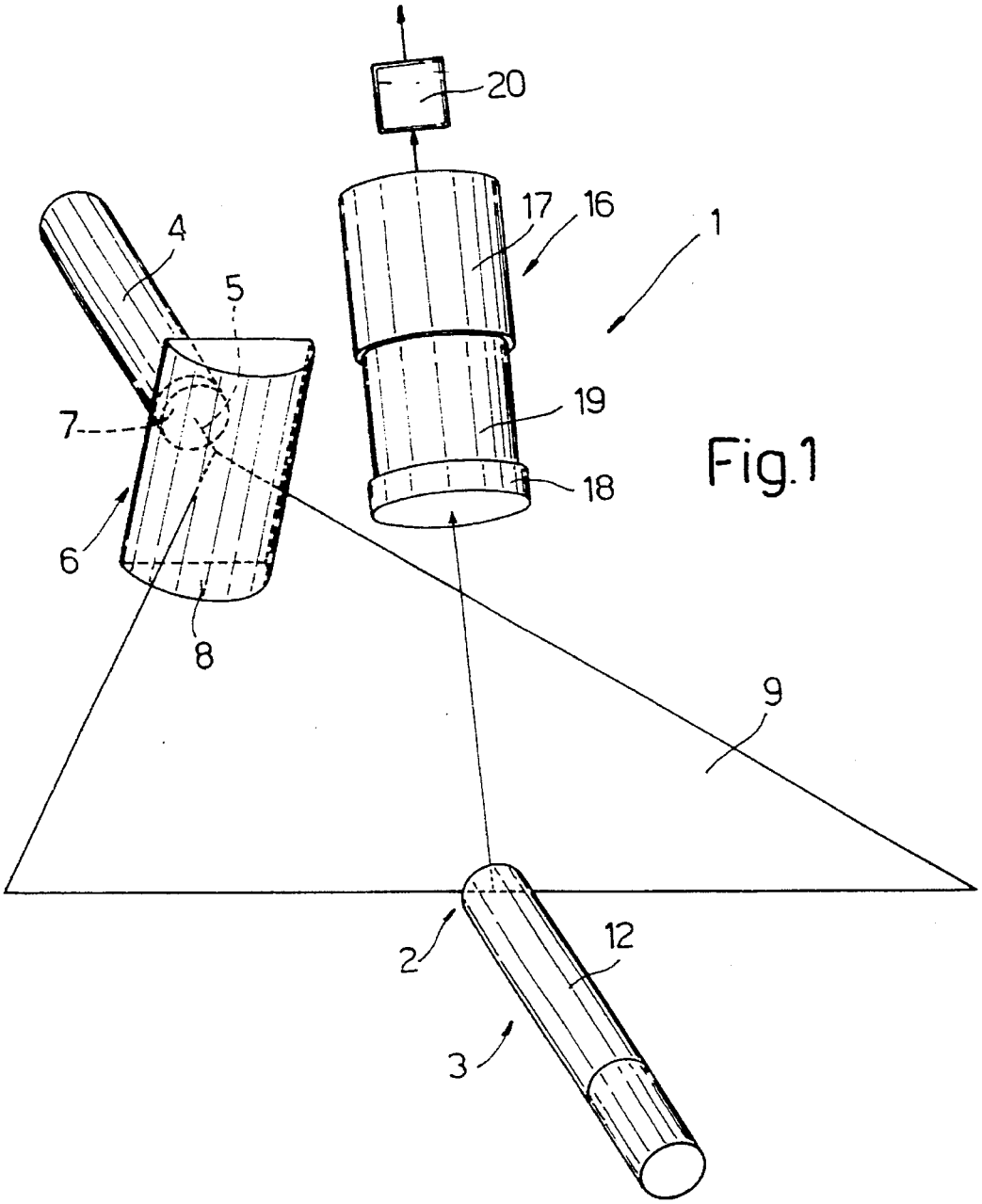
FIG. 1 shows a schematic view in perspective of a preferred embodiment of the optical device according to the present invention.

Numeral 1 in FIG. 1 indicates an optical device for controlling the filling of an end portion 2 of a cigarette 3. Device 1 comprises a laser source 4, preferably consisting of a laser diode, for emitting a coherent light beam 5; and a focusing unit 6 comprising a focusing lens 7 and a cylindrical lens 8. Lens 8 provides for converting the focused beam 5 into a coherent light blade 9 impinging, at an angle A of less than 90°, on a plane 10 defined by the annular end edge 11 of the outer paper layer 12 of cigarette 3. More specifically, blade 9 intersects plane 10 along a line 13 in turn intersecting edge 11 at two points B and C.

Figure 4:
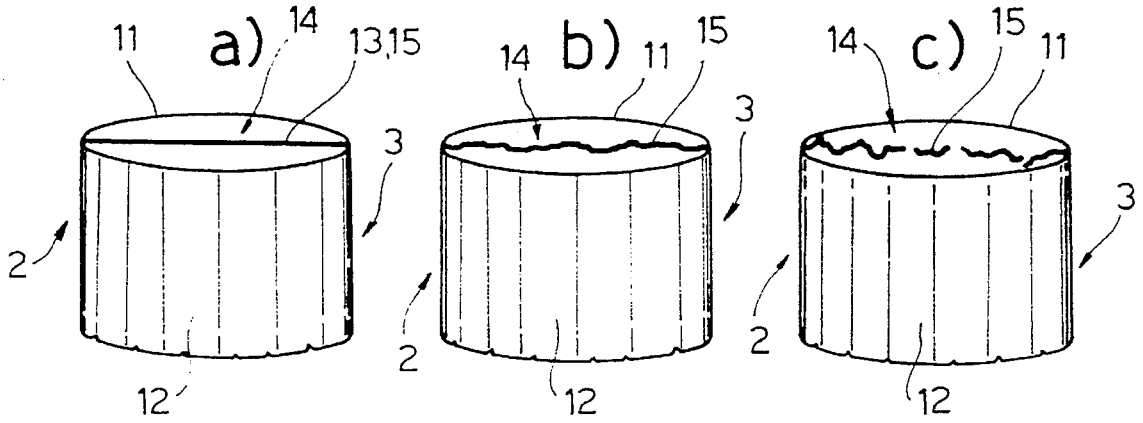
FIG. 4A, 4B and 4C show example diagrams of different results obtainable using the FIG. 1 optical device.

As shown in FIG. 4, blade 9 also intersects the end surface 14 of end portion 2 of cigarette 3 to define, on surface 14, a light trace 15 having the same end points B and C as line 13.

As shown in FIG. 4, in the purely theoretical case of a perfect cigarette 3, i.e. wherein surface 14 (FIG. 4*a*) is absolutely flat and coplanar with plane 10, trace 15 matches line 13 which is adopted as a theoretical reference trace. In the case of a real cigarette, on the other hand, surface 14 may be undulated (FIG. 4*b*), in which case trace 15 is a wavy line, the deviations of which in relation to line 13 indicate variations in the level of surface 14; or a surface with interruptions or gaps (FIG. 4*c*), in which case trace 15, in addition to being undulated, is also discontinuous.

Figure 3:
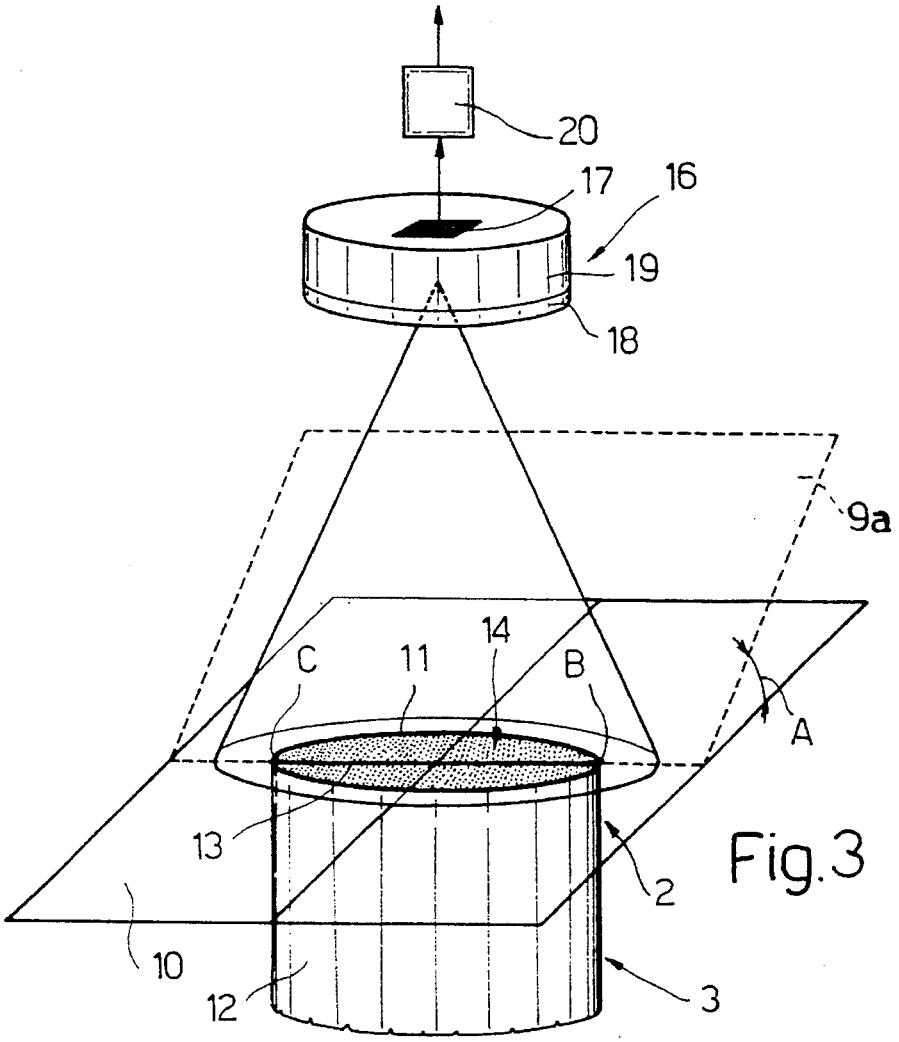
FIG. 3 shows a schematic view in perspective of a second detail in FIG. 1.

Device 1 also comprises an optical detecting unit 16 positioned (FIG. 3) facing surface 14 and in turn comprising a sensor 17, preferably a photodiode array sensor, which receives an image of surface 14 and trace 15 via a filter 18 and a lens system 19, and is connected to the input of a processor 20.

As the opposite end points of trace 15 undoubtedly coincide with the points at which blade 9 intersects edge 11, i.e. points B and C, processor 20, on receiving the image of trace 15, computes line 13, determines the deviations of trace 15 in relation to line 13 and the interruptions in trace 15, and emits a signal for rejecting cigarette 3 in the event, for example, the ratio between the number of dots (pixels) of trace 15 within a relatively narrow range of line 13 and the number of dots of trace 15 outside said range is below a given value.

Figure 5:
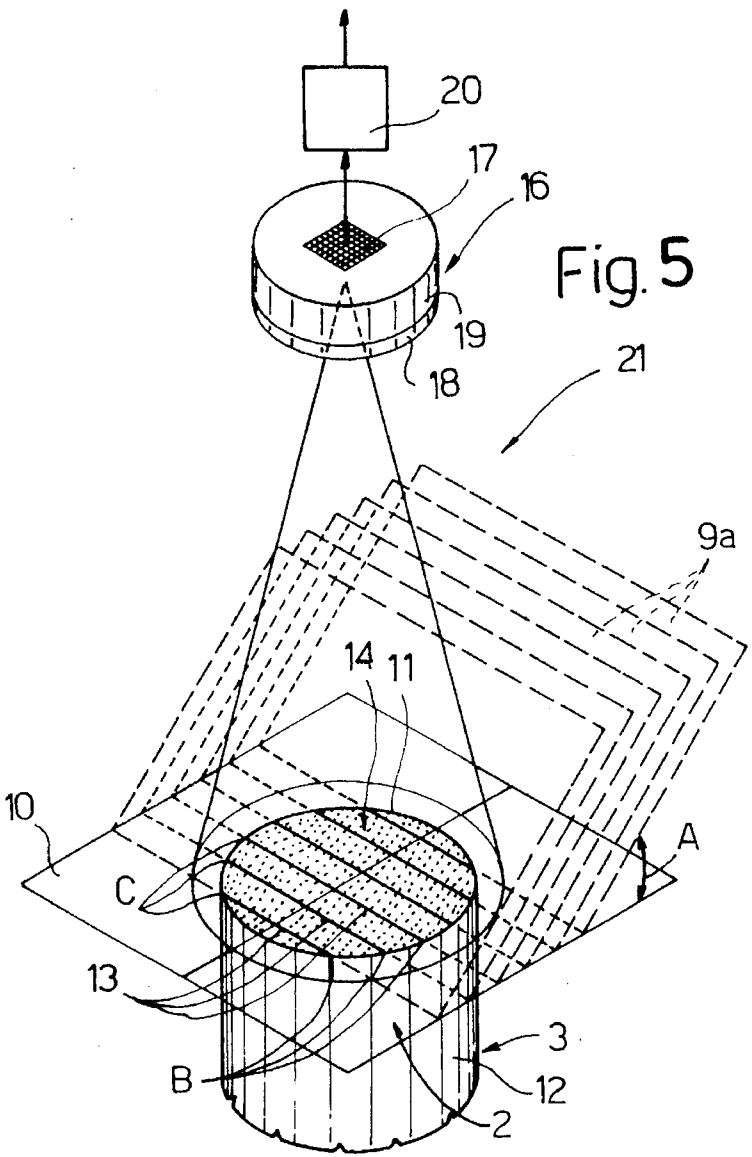

The FIG. 5 variation relates to an optical device 21 differing from device 1 solely in that beam 5 emitted by source 4 is divided by a known divider (not shown) into a number of coherent light blades (not shown) lying in respective parallel planes 9*a* and impinging on plane 10 at respective angles A of less than 90°, so as to define, on end surface 14 of end portion 2 of cigarette 3, respective light traces 15 which, when detected by optical unit 16, provide for highly accurately evaluating the conformation of surface 14.

Figure 6:
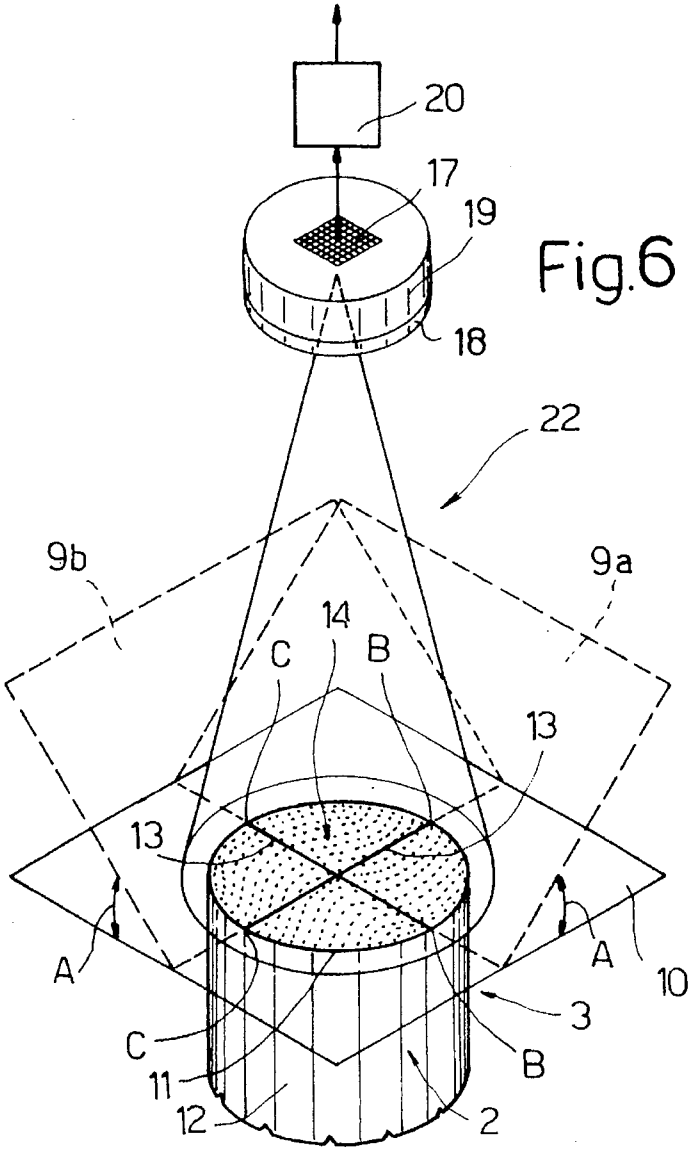
FIGS. 5 and 6 show schematic views in perspective of two variations of the FIG. 3 detail.

The FIG. 6 variation relates to an optical device 22 differing from device 1 solely in that beam 5 emitted by source 4 is divided by a known divider (not shown) into two coherent light blades (not shown) lying in respective perpendicular planes 9*a*, 9*b* and impinging on plane 10 at respective angles A of less than 90°, so as to define, on end surface 14 of end portion 2 of cigarette 3, two perpendicular light traces 15 which, when detected by optical unit 16, provide for highly accurately evaluating the conformation of surface 14.

Devices 1, 21 and 22 may of course be combined to form further optical detecting devices for evaluating the conformation of surface 14.

What is claimed is:

1. An optical control method for determining a filling state of a cigarette with tobacco, said method comprising:

producing from at least one laser source, at least one coherent light blade lying in a plane, directing said at least one coherent light blade onto a surface of a cigarette at an open end of the cigarette to produce a respective real light trace indicative of level of tobacco filling the cigarette, forming a theoretical, straight, continuous trace by joining two end points of said real light trace, comparing said real light trace and said theoretical trace to determine any deviation therebetween, and determining acceptability or not of the filling of the cigarette with tobacco based on said deviation between the real light trace and said theoretical trace.

2. A method as claimed in claim 1, comprising producing a second coherent light blade from said at least one laser source, directing said second light blade onto said open end of the cigarette at a location offset from said first light blade, and producing a respective second real light trace by said second light blade.

3. A method as claimed in claim 2, comprising disposing said two light blades in parallel.

4. A method as claimed in claim 2, comprising disposing said two light blades in substantially perpendicular relation.

5. A method as claimed in claim 2, comprising disposing said two light blades each at an angle of less than 90° with respect to a plane passing through said open end of the cigarette.

6. A method as claimed in claim 1, wherein said real light trace and said theoretical trace are compared by dividing said real light trace into a plurality of successive pixels, and determining any deviation of said pixels from said theoretical trace.

7. A method as claimed in claim 6, wherein said determining acceptability or not of the filling of the cigarette is achieved by evaluating said deviation of said pixels from said theoretical trace.

8. A method as claimed in claim 7, wherein said evaluation is effected by determining how many pixels deviate from said theoretical trace by more and less than a predetermined amount.

9. A method as claimed in claim 8, comprising forming a ratio of the number of pixels deviating by less than the predetermined amount from the theoretical trace and the number of pixels deviating by more than the predetermined amount from the theoretical trace and generating a signal to reject the cigarette when said ratio is below a predetermined value.

10. An optical control device for determining a filling state of a cigarette with tobacco, said apparatus comprising:

laser emitting means for emitting at least one coherent light beam, at least one focussing means for converting said at least one coherent light beam into a coherent light blade directed onto a surface of a cigarette at an open end thereof to produce a real light trace indicative of a level of tobacco filling the cigarette, sensor means for detecting said real light trace, and processing means for analyzing any deviation or discontinuity of said real light trace in relation to a theoretical, straight, continuous light trace formed by joining two end points of the real light trace and for producing a signal indicating acceptance or rejection of the cigarette based on said deviation or discontinuity.

11. Apparatus as claimed in claim 10, wherein said laser emitting means and said at least one focussing means produce two coherent light blades which are located in respective planes offset from one another.

12. Apparatus as claimed in claim 11, wherein said planes of said light blades are parallel to one another.

13. Apparatus as claimed in claim 11, wherein said planes of said light blades are substantially perpendicular to one another.

14. Apparatus as claimed in claim 10, wherein said at least one focussing means is arranged to direct said at least one coherent light beam onto said surface of the cigarette at an angle less than 90°.

15. Apparatus as claimed in claim 10, wherein said at least one focussing means comprises a focussing lens and a cylindrical lens.

16. Apparatus as claimed in claim 10, wherein said sensor means comprises a photodiode array sensor.

* * * * *